US005531544A

United States Patent [19]

Willcox, II

[11] Patent Number: 5,531,544

[45] Date of Patent: Jul. 2, 1996

[54] PILE CAP

[75] Inventor: Frederick E. Willcox, II, Houston, Tex.

[73] Assignee: Perma Pile Foundation Restoration Systems, Inc., Houston, Tex.

[21] Appl. No.: 323,502

[22] Filed: Oct. 14, 1994

Related U.S. Application Data

[63] Continuation of Ser. No. 854,775, Mar. 23, 1992, abandoned, which is a continuation of Ser. No. 628,459, Dec. 17, 1990, abandoned.

[51] Int. Cl.[6] ..... E02D 5/22

[52] U.S. Cl. ..... 405/231; 405/255

[58] Field of Search ..... 405/229–232, 405/244, 255, 256

[56] References Cited

U.S. PATENT DOCUMENTS

| | | | |
|---|---|---|---|
| 1,979,670 | 11/1934 | Brune et al. | 405/230 |
| 3,199,300 | 8/1965 | Fiore | 405/251 |
| 3,410,097 | 11/1968 | Young | 405/255 |
| 3,581,508 | 6/1971 | Junius | 405/255 |

FOREIGN PATENT DOCUMENTS

| | | | |
|---|---|---|---|
| 517334 | 5/1921 | France | 405/231 |
| 71954 | 6/1931 | Sweden | 405/230 |
| 621822 | 7/1978 | U.S.S.R. . | |
| 684097 | 9/1979 | U.S.S.R. . | |
| 715712 | 2/1980 | U.S.S.R. | 405/255 |
| 977580 | 11/1982 | U.S.S.R. . | |
| 981560 | 12/1982 | U.S.S.R. . | |
| 988981 | 1/1983 | U.S.S.R. . | |
| 1173003 | 8/1985 | U.S.S.R. | 405/255 |
| 2092212 | 8/1982 | United Kingdom | 405/244 |

*Primary Examiner*—Eric K. Nicholson
*Assistant Examiner*—John A. Ricci
*Attorney, Agent, or Firm*—Vaden, Eickenroht & Thompson

[57] ABSTRACT

A pile cap of homogeneous material is disclosed that includes a top member part having a relatively large top area and a base member part having a correspondingly smaller bottom area. The sides of at least the bottom member part are thereby tapered. The bottom area preferably includes a recess for accommodating the top of a cylindrical pile. The shape distributes even an unbalanced load having an off-center moment of force to the top of the pile without creating potentially damaging shear stresses along the sides of the pile cap.

1 Claim, 3 Drawing Sheets

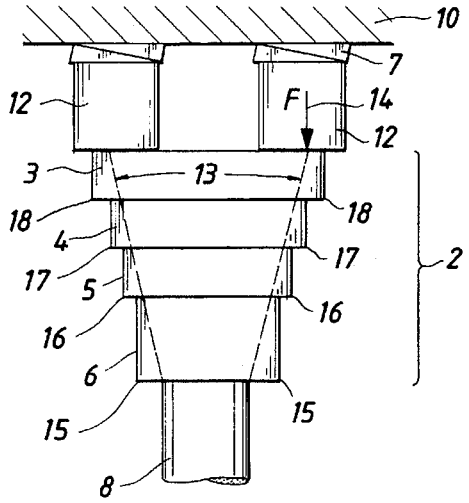
FIG.1
(PRIOR ART)
FIG.2
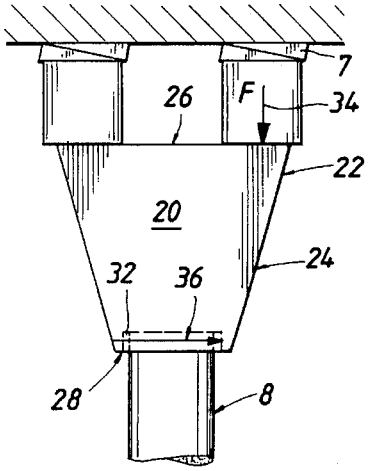
FIG.3
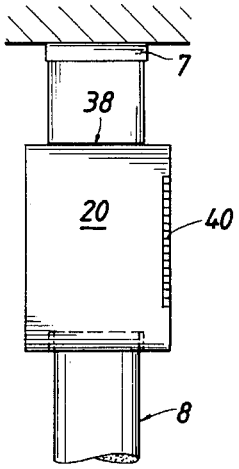
FIG.4
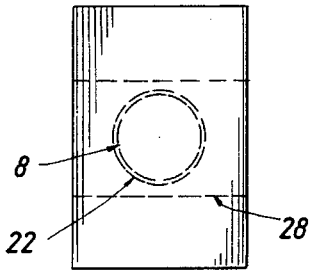
FIG.5
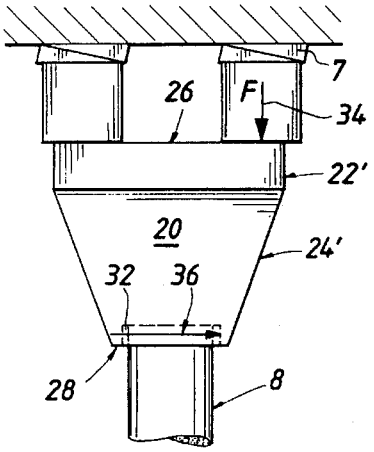
FIG.6
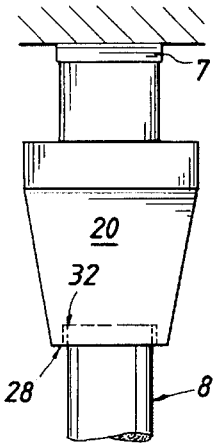
FIG.7
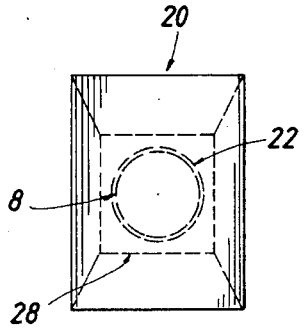

PILE CAP

This patent application is a continuation of application Ser. No. 07/854,775, filed Mar. 23, 1992, now abandoned, which is a continuation of application Ser. No. 07/628,459, filed Dec. 17, 1990, now abandoned.

BACKGROUND OF THE INVENTION

1. Field of the Invention

This invention relates to the field of foundations for buildings and other structures. More particularly, this invention relates to a pile cap employed in a foundation repair procedure, such pile cap being aligned between a load and a leveling pile positioned in the soil beneath the load.

2. Description of the Prior Art

Many buildings and other types of structures have been built on foundations or slabs made of concrete poured on top of soil. Constant changes in the weather and moisture levels in the soil frequently cause damage to such a foundation. In many instances, the foundation may buckle or even crack. This phenomenon occurs because prior to placing the foundation on the ground, the moisture beneath it is constant. Placing a foundation on the soil distorts the evaporation of the moisture underneath the foundation, thereby causing water build-up and relative soil swelling in the middle of the structure. Eventually, an uplifting can occur in the center because the moisture from around the edges relative to the center is drawn away by evaporation and/or by wicking action of the adjacent shrubbery. Over a period of time the foundation can "dome", causing its damage or failure.

There are several methods used in repairing foundations, some more effective than others. One of the most effective and widely used methods includes the use of one or more piles submerged into the soil beneath the foundation to form one or more supports. For clarity, the words "pile" and "piling" are synonymous terms signifying a single structure and the words "piles" and "pilings" are synonymous terms signifying a plural structure of more than one pile.

In such a procedure, there are several ways to construct and position a pile. Regardless of the manner in which a pile is constructed, however, most are made primarily of concrete and have an overall cylindrical shape with a length varying according to the soil type and weight of the structure. Most are positioned such that the top of the pile is within a relatively short distance from the bottom of the foundation.

Once the pile is positioned, the force of the building or other supported structure must be distributed on to the pile. Generally, the pile diameter is small relative to the downward force of the foundation; therefore, a means for gradually distributing the weight onto the pile is necessary. One way existing in the prior art to provide for such distribution is the use of a pile cap system consisting of different sized concrete blocks. The blocks are arranged to form an upside down or inverse stair-stepped frustum, with the block plane of the smallest surface area being placed on top of the pile. The other blocks are graduated in size upward from the top of the block on the pile to the foundation.

Several problems exist with the pile cap system just described. First, the blocks are heavy, cumbersome, and PATENT difficult to maneuver. The positioning of the blocks relative to each other, the pile, and the foundation is critical; therefore, the maneuverability of the blocks is important. Once the blocks are in place, one or more power jacks or some other lifting means is positioned between the top concrete block and the foundation. These jacks are then used to lift the foundation to the necessary level, at which point they are replaced with additional permanent blocks.

The reason their positioning is critical is because of the unequal distribution of forces onto the pile cap system that create a rotational moment which, in turn, inherently makes the system unstable. A second problem associated with such a pile cap system is the destructive effect the shear stress has on the corners of the blocks that respectively overhang the corners of the blocks beneath them. Such stress can result in corner shearing and even without shearing reduces the strength of the blocks.

It is therefore a feature of this invention to provide an improved pile cap that is of lighter weight and is more maneuverable than those existing in the prior art.

It is also a feature of this invention to provide an improved pile cap that has an inherent resistance to the angular moment produced by the unequal distribution of forces onto the pile beneath the pile cap.

It is still a further feature of this invention to provide an improved pile cap that has a structure to minimize the destructive effects of shear stress on a pile cap.

SUMMARY OF THE INVENTION

The current invention was designed to reduce the destructive effects of the shear stress on a pile cap and PATENT to increase the resistance against the rotational moment produced by the unequal distribution of forces on such a pile cap. The inventive structure comprises a pile cap having two member parts, an upper member part with a top surface area and a base member part with a bottom surface area, the bottom surface area always being less than the top surface area. Both member parts together comprise one homogenous structure. At least the base member part has tapered sides. The tapering of the sides of the structure reduces the destructive effect of shear stress. The sides of the upper member part can either be tapered or vertical. The base member part preferably also has a recessed bottom that is adaptable for placement on top of the piling. This recess provides added resistance to that provided by an inverse, homogeneous frustum against an off-center moment from the unequal distribution of forces applied to the pile cap during use. The shape of the top surface area of the upper member part and the bottom surface area of the base can vary. Such shapes can be, for example, rectangular, square, circular, or elliptical.

BRIEF DESCRIPTION OF THE DRAWINGS

So that the manner of the above-recited features, advantages, and objects of the invention, as well as others which will become apparent are attained and can be understood in detail, a more particular description of the invention briefly summarized above may be had by reference to the exemplary preferred embodiments thereof illustrated in the drawings that form a part of this specification. It is nevertheless to be noted that the appended drawings illustrate only preferred embodiments of the invention and are not to be considered limiting of its scope as the invention may admit to other equally effective embodiments.

In the Drawings:

FIG. 1 is a front view of the pile cap system used in the prior art.

FIG. 2 is a front view of a preferred embodiment of the present invention.

FIG. 3 is a side view of the preferred embodiment shown in FIG. 2.

FIG. 4 is a top view of the preferred embodiment shown in FIG. 2.

FIG. 5 is a front view of an alternate embodiment of the present invention.

FIG. 6 is a side view of the alternate embodiment shown in FIG. 5.

FIG. 7 is a top view of the alternate embodiment shown in FIG. 5.

DESCRIPTION OF THE PREFERRED EMBODIMENT

Figure 2A:
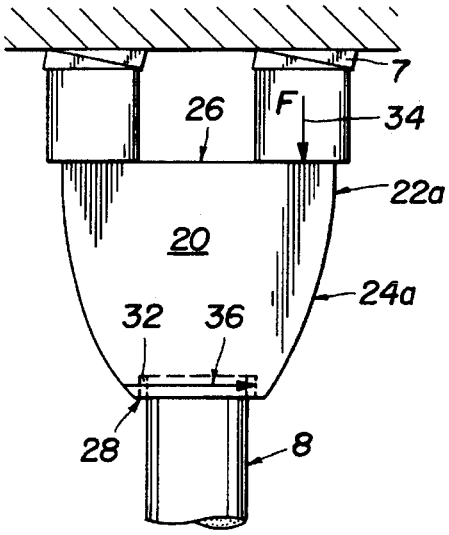
FIG. 2*a* is a front view of an alternate embodiment of the present invention.

Now referring to the drawings and first FIG. 1, a typical pile cap system used in the prior art is illustrated. Pile cap system 2 comprises from top to bottom individual concrete rectangular blocks 3, 4, 5, and 6, block 6 resting on top of a pile 8. It is noted that block 3 is larger in horizontal plane area than block 4, block 4 is larger in horizontal plane area than block 5, and block 5 is larger in horizontal plane area than block 6. The horizontal plane of block 6 is larger than the area of the top of the pile. Both pile system 2 and pile 8 are positioned below foundation or concrete slab 10.

Once pile system 2 and pile 8 are properly positioned, lifting means, which can conveniently be in the form of one or more power jacks 12, are placed between the top of pile system 2 and foundation 10. The lifting means are replaced by permanent blocks after final vertical positioning of the foundation has been achieved. Alternatively, any type of permanent uplifting system and permanent installation structure to achieve the same results can be used. Steel shims 7 are employed as needed. Power jacks 12 are adjusted in use to raise foundation 10 to the appropriate level. In most instances, regardless of where the lifting means are placed relative to the top of pile cap system 2, an unequal distribution of forces creates a rotational moment on the pile cap system. For instance, if the cumulative downward force on pile cap system 2 is represented by arrow 14, pile cap 2 will be affected by the rotational moment associated with this force to cause the overall system to be unstable. In the past, it has been difficult to compensate for such moment effects because of the unpredictability of their positions and magnitudes, the relatively unstable condition of the blocks, and the shear forces placed on the block corners, as described hereafter.

Pile cap system 2 is affected by the shear forces associated with the downward pressure or weight of foundation 10. Assuming the two power jacks 12 shown in FIG. 1 both apply force to pile cap system 2, a shear force associated with each of these power jacks 12 is developed along lines 13 which extends from the lifting means down to the pile 8, resulting in a destructive effect on corners 15, 16, 17 and 18 of blocks 6, 5, 4, and 3, respectively.

Figure 2B:
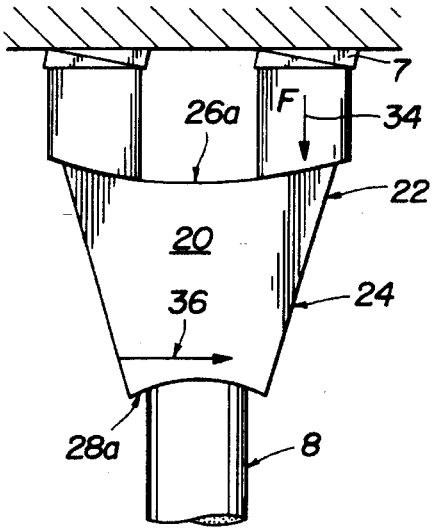
FIG. 2*b* is a front view of another alternate embodiment of the present invention.
Figure 4A:
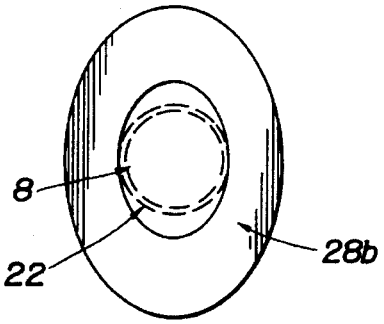
FIG. 4*a* is a top view of an alternate embodiment shown in FIG. 2*a*.

This invention overcomes the many problems associated with the structure of the prior art pile cap system in FIG. 1. A preferred embodiment of this invention is illustrated in FIGS. 2, 3, and 4. Pile cap 20 is a single structure made up of a homogenous material of sufficient strength necessary to withstand heavy loads, such as a reinforced concrete material. Fiberglass and needles of steel can be employed to reinforce the concrete, as is well known in the art. Depending on the type of material used in pile cap 20, steel reinforcement rods may also be incorporated into the pile cap structure.

Referring to FIG. 2, pile cap 20 can be conveniently analyzed as being made up of two member parts, upper member part 22 and base member part 24. Upper member part 22 has a substantially horizontal top surface area 26. Base member part 24 has a smaller bottom surface area 28, which includes recess 32, making pile cap 20 adaptable for placement on pile 8. That is, recess 32 is sized and shaped to conveniently receive the top of pile cap 8, as best shown in FIG. 4. Bottom surface area 28 is always small in size with respect to top surface area 26. As with the prior art structure, steel shims 7 are employed as needed.

Recess 32 provides a resistance to any rotational moment caused by the downward force on the pile cap. For instance, moment creating force 34 on pile cap 20 would be resisted by force 36. Thus, force 34, which may be even sufficiently off-center so as to be vertically outside of the limits of pile 8, is translated to a force 36 within the limits of the top of pile 8 without causing potentially harmful shear forces along the sides or skin of the pile cap. Thus, the preferred shape of the pile cap is an inverse, truncated, symmetrical pyramid with contiguous tapered sides for both its upper member and base member portions. The width of recessed area 32 can vary but is generally slightly larger than the width of pile 8. The height of the recessed area from the bottom surface area can also vary, but is usually around 1 inch for a standard size pile. The shape of the recess preferably concentrically corresponds with the shape of the top of the pile, as shown in FIG. 4.

As mentioned, in this preferred embodiment, both upper member part 22 and base member part 24 have contiguous tapered sides which join to create one homogenous structure having a top surface surface area 26 and a bottom surface area 28. The exact angle of the tapered side is proportional to the height of pile cap 20, the size of bottom surface area 28, and the size of top surface area 26, all determined by the load, the size of the pilings and the number and spacing of the pilings in the overall piling system. Although the pile cap size will be determined in part by the load requirements and the size of the pile, a typical size for such a pile cap is 19 by 7 inches for top surface area 28, 7 by 7 inches for bottom surface area 26, and 12 inches for its vertical dimension. Such dimensioning enables the bottom surface area to have a circular recess 8 with a diameter slightly in excess of 6 inches to accommodate the top of a nominal 6-inch diameter pile. The depth of the recess from the plane of the bottom that accomodates to a standard sized pile is usually a nominal one inch.

It is also desirable to include a vertical scale 40 along at least one side of pile cap 20, such scale having descending incremental steps for allowing the monitoring of settlement of the vertical load when the pile cap is in service.

Figure 5A:
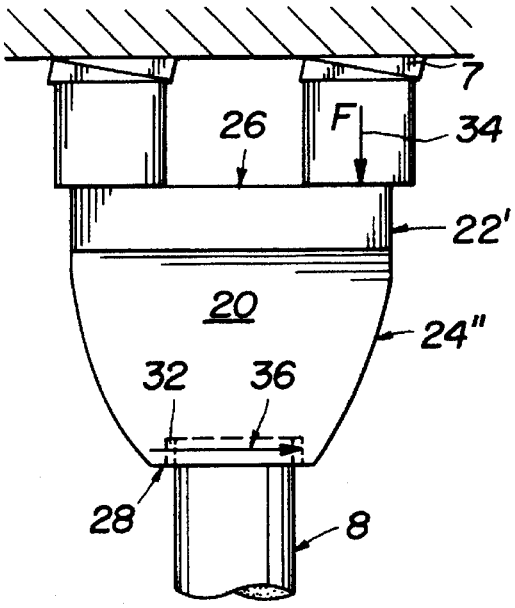
FIG. 5*a* is a front view of the alternate embodiment of FIG. 5 having convex tapered sides.
Figure 6A:
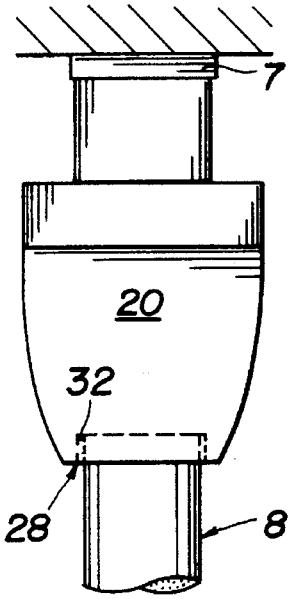
FIG. 6*a* is a side view of the alternate embodiment of FIG. 5 having convex tapered sides.
Figure 7A:
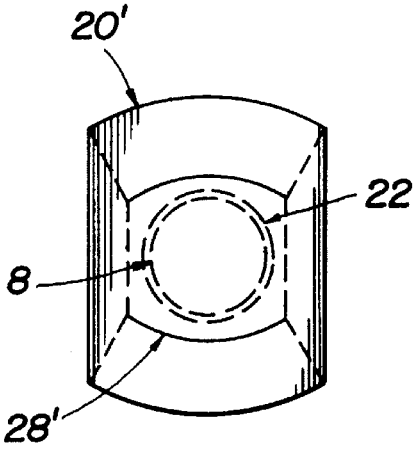
FIG. 7*a* is a top view of the alternate embodiment in FIG. 5 having an elliptical shaped top surface and bottom surface.

Now referring to the alternate embodiment shown in FIGS. 5, 6, and 7, the pile cap shown can be analyzed in the same manner as for the pile cap shown in FIGS. 2, 3, and 4. That is, the pile cap can be considered to comprise upper member part 22' and base member part 24'. In this case, the upper member part has vertical sides, rather than tapered sides. Alternatively, the sides of upper member part 22 depending from the top surface can be other than vertical, but at a steeper or greater angle than the tapered sides of base member part 24'. In any event, the sides of the upper member part and the sides of the base member part are contiguous and join together in a matching and homogeneous fashion, as illustrated.

In addition to having a different side slope structure, bottom member portion can include a bottom area that is different in dimension from the smallest side of top surface area 26. For the first embodiment, the smallest side of top surface area 26 was described as being an exemplary 7 inches, the same as the sides of area 28. However, in FIG. 7, it can be seen that the dimensions of area 28 can be smaller than even the smallest dimension of area 26, thereby determining the slopes of the sides base member part 24' to mate with the sides of top member part 22'. Otherwise, the structures of the illustrated embodiments are the same.

It should be noted that the size and shape of the piles described and illustrated herein allow them to be conveniently cast as single, homogeneous structures.

While two separate embodiments have been described and illustrated, and alternately dimensioned structures have been discussed, it will be understood that the invention is not limited thereto, since many modifications may be made and will become apparent to those skilled in the art. For instance, the sides of upper member parts 22 and 22' and of lower member parts 24 and 24' have been described as being straight. Alternatively, any of these sides can be convexly rounded, if desired. Also, the bottom of the described pile caps have been described as including a recess for accommodating the top of a pile. Although preferred, a recess is not required for a pile cap in accordance with the present invention.

The pile cap of the illustrated embodiments includes a rectangular top area and a square bottom area. Alternatively, either area can be rectangular, square, circular, elliptical, curvilinear or other geometric shape, as desired. For shapes having rectangular or square top and bottom surface areas, the sides would form an inverse, symmetrical truncated pyramid with the upper and bottom surfaces. For shapes not having rectangular or square top and bottom surface areas, the sides would form an inverse, symmetrical frustum with the upper and bottom surfaces.

What is claimed is:

1. A positionable pile cap separate and apart from the structure supported by it, said pile cap being of homogeneous material for mounting on top of a construction piling and adapted to redistribute the downward force of the vertical load on the piling, comprising an upper member and a base member;

said upper member being separate from the supported structure and having a substantially horizontal top surface area;

said base member being separate from the piling, and having a substantially horizontal bottom surface area of lesser dimension than said top surface area;

said top surface area and said bottom surface area being proportionally dimensioned;

said bottom surface area being recessed for placement on the piling;

tapered sides joining said upper member and said base member wherein the angle of the sides is proportional to the height of the pile cap; and at least one of said tapered sides includes a vertical scale for allowing the monitoring of settlement of the vertical load by accessing the pile cap when it is in service.

* * * * *

UNITED STATES PATENT AND TRADEMARK OFFICE

CERTIFICATE OF CORRECTION

PATENT NO. : 5,531,544
DATED : July 2, 1996
INVENTOR(S) : Frederick E. Willcox

It is certified that error appears in the above-indentified patent and that said Letters Patent is hereby corrected as shown below:

Column 1, line 64 and column 2, line 30, delete "PATENT".

Signed and Sealed this

First Day of October, 1996

*Attest:*

Bruce Lehman

BRUCE LEHMAN

*Attesting Officer*

*Commissioner of Patents and Trademarks*